US006437500B1

(12) United States Patent
Leahey et al.

(10) Patent No.: US 6,437,500 B1
(45) Date of Patent: Aug. 20, 2002

(54) SEAMLESS ELECTRON TRANSFER FOR MULTIPLE-GUN DIRECT VIEW CRTS

(75) Inventors: James Kevin Leahey; Ajay Sharma, both of San Diego, CA (US)

(73) Assignees: Sony Corporation, Tokyo (JP); Sony Electronics Inc., Park Ridge, NJ (US)

( * ) Notice: Subject to any disclaimer, the term of this patent is extended or adjusted under 35 U.S.C. 154(b) by 0 days.

(21) Appl. No.: 09/384,187

(22) Filed: Aug. 27, 1999

(51) Int. Cl.[7] ..... H01J 29/70; H01J 29/50

(52) U.S. Cl. ..... 313/421; 313/440; 313/437; 313/415; 313/409; 313/2.1

(58) Field of Search ..... 313/440, 421, 313/437, 409, 415, 2.1

(56) References Cited

U.S. PATENT DOCUMENTS 3,819,984 A * 6/1974 Hawken ..... 315/27
4,712,038 A * 12/1987 Takenaka et al. ..... 313/2.1
4,714,856 A * 12/1987 Takenaka et al. ..... 313/2.1
4,777,407 A * 10/1988 Takenaka et al. ..... 315/9
5,498,921 A * 3/1996 Nishimura et al. ..... 313/2.1
6,061,038 A * 5/2000 Washburn ..... 345/12

* cited by examiner

*Primary Examiner*—Nimeshkumar D. Patel
*Assistant Examiner*—Sikha Roy
(74) *Attorney, Agent, or Firm*—Crosby, Heafey, Roach & May

(57) ABSTRACT

A CRT for the display of a large screen television set which includes a tube envelope having a pair of tube necks and a phosphor display screen, a pair of electron guns arranged in a same horizontal plane and each positioned in a different one of the tube necks, for directing dual electron beams to impinge upon the phosphor display screen, and magnetic deflection yokes for horizontally deflecting the dual electron beams to produce a visual display of partially overlapping dual raster scans on the display screen.

8 Claims, 2 Drawing Sheets

SEAMLESS ELECTRON TRANSFER FOR MULTIPLE-GUN DIRECT VIEW CRTS

BACKGROUND OF THE INVENTION

Users of direct view conventional screen cathode ray tube (CRT) television sets have been unsatisfied because the footprint of such sets takes up a large amount of room and is not aesthetically pleasing. Such problems have been exaggerated with the introduction and popularity of large size models, e.g., those greater than 32" (measured on the diagonal) screen size. At the same time, the cost to performance ratio of such direct view CRTs is generally much better than that of thinner, rear projection sets.

As a result, there is a need for a direct view CRT set with a dramatically reduced depth, for example, one half the depth of conventional sets.

SUMMARY OF THE INVENTION

A cathode ray display tube including a tube envelope, a display screen, a pair of electron guns for directing dual electron beams to impinge upon the display screen, deflection means for deflecting the dual electron beams to produce a visual display of partially overlapping dual raster scans on the display screen, and wherein the tube envelope contains the display screen and the pair of electron guns.

In the preferred embodiment, the tube envelope includes a pair of spaced apart tube necks, each housing a different one of the electron guns. The electron guns reside in a same horizontal plane.

The deflection means include a pair of magnetic deflection yokes, each positioned around a separate tube neck. The horizontal deflection power supply includes a circuit for supplying a random current to each of the magnetic deflection yokes. This causes the transfer point of each of the dual beams, within an area of the partial overlap of the dual raster scans, to be varied to minimize the possibility of a visible seam in the visual display.

In the preferred embodiment, the CRT according to the invention is used for the display of a large screen television set including a tube envelope having a pair of tube necks and a phosphor display screen, a pair of electron guns arranged in a same horizontal plane and each positioned in a different one of the tube necks, for directing dual electron beams to impinge upon the phosphor display screen, and magnetic deflection yokes for horizontally deflecting the dual electron beams to produce a visual display of partially overlapping dual raster scans on the display screen.

Each magnetic deflection yoke is positioned around a separate tube neck. The magnetic deflection yokes cause the transfer point of each of the dual beams, within an area of the partial overlap of the dual raster scans, to be varied to minimize the possibility of a visible seam in the visual display. This effect is caused by supplying a random current to each of the magnetic deflection yokes.

The foregoing and other objectives, features and advantages of the invention will be more readily understood upon consideration of the following detailed description of certain preferred embodiments of the invention, taken in conjunction with the accompanying drawings.

DETAILED DESCRIPTION OF THE PREFERRED EMBODIMENTS

Figure 1:
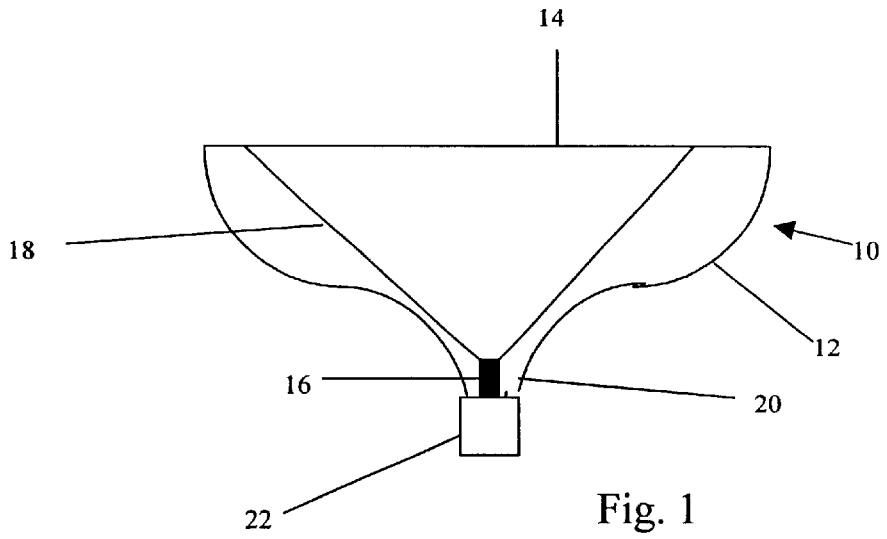
Fig. 1 PRIOR ART
FIG. 1 is a diagram of a cross-section of a conventional CRT.

Referring to FIG. 1, a conventional CRT 10 typically includes a tube envelope 12 having a neck 20 and a phosphor display screen 14, and an electron gun 16 mounted in the CRT neck 20. In a manner known per se, the electron gun is energized (by circuits not shown) to produce an electron beam. A deflection yoke 22 magnetically deflects the electron beam 18 in the vertical and horizontal directions according to a saw-toothed pattern to produce a raster scan on the face of the display screen 14. The turning on and off of the electron beam at discrete moments causes small portions (pixels) of the display screen to illuminate or not, thereby producing a picture in a manner known per se.

This arrangement of the elements of the CRT 10 imposes restrictions on how deep the tube can be for a given diagonal dimension of the display screen 14. "Depth" refers here to the distance from the front of the display screen to the back end of the tube neck 22. This is because the electron beam, in order to have a relatively wide deflection to cover a large screen face, must be set back from the screen face by a relatively large distance as compared to conventional, smaller screen CRTs.

Figure 2:
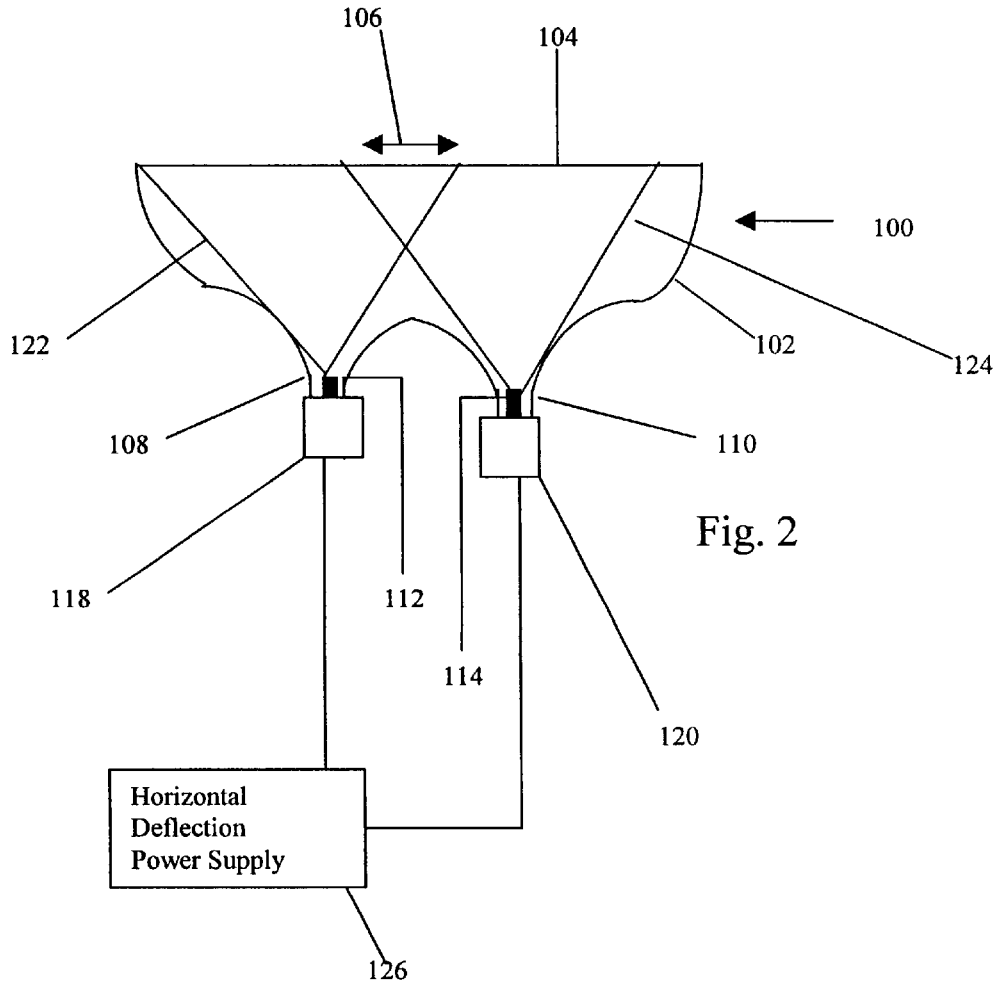
FIG. 2 is a diagram of a cross-section of a CRT constructed according to the present invention.

The tube construction of the CRT according to the present invention overcomes this problem. The CRT tube 100 includes a tube envelope 102 having two necks 108 and 110 each containing separate electron guns 112 and 114, respectively, for scanning one horizontal screen 104. Separate magnetic deflection yokes 118 and 120 scan each electron beam 122 and 124, respectively, together to produce an overlapped raster scan. The area of overlap is denoted be reference number 106 in FIGS. 2 and 4.

A horizontal deflection power supply 126 supplies a current to each of the coils of the deflection yolks 118 and 120 that determines the amount of scan area. A random current to the deflection yolks can vary this voltage. The power supply 126 is designed to produce a random current so that the amount of overscan varies with each frame of the picture. The television usually has 60 frames/second. By achieving a random current to the deflection yolks 118 and 120, the human eye is unable to pick up the line caused by the two electron beams interfering with each other.

In particular, the horizontal deflection size is controlled by the horizontal deflection power supply 126 which supplies a constant current through the deflection yolks 118 and 120 (for example 5.3 amps). To achieve a different area of scan for each side of the screen, this current is varied a little to increase/decrease the picture size. Each time the frame scans the screen (1/60 second at the current NTSC format), the current is varied by the horizontal deflection power supply 126 by about +/−10%. Every frame then has a random current through the deflection yolks 118 or 120. Alternatively, even a large number of set voltages could be programmed and repeated over and over again.

Figure 3:
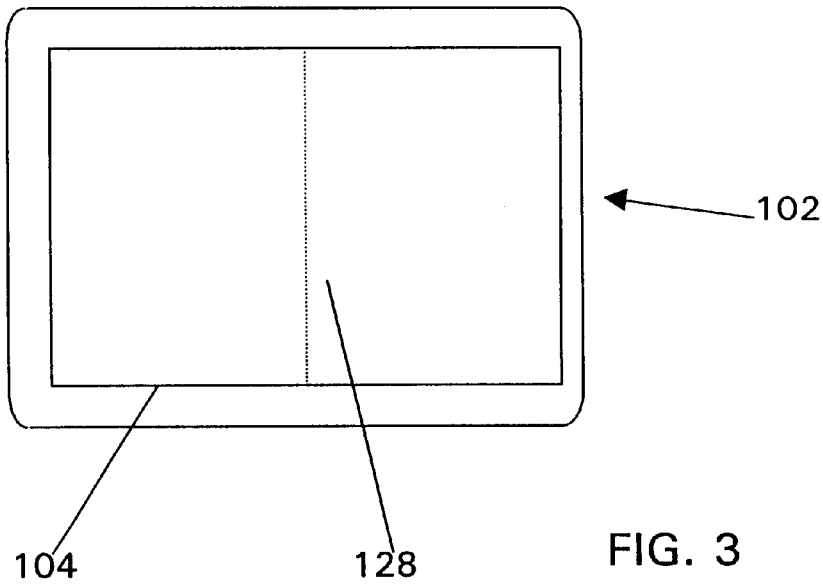
FIG. 3 is a diagram showing the screen face of a CRT having dual guns but no overlapping raster scans.
Figure 4:
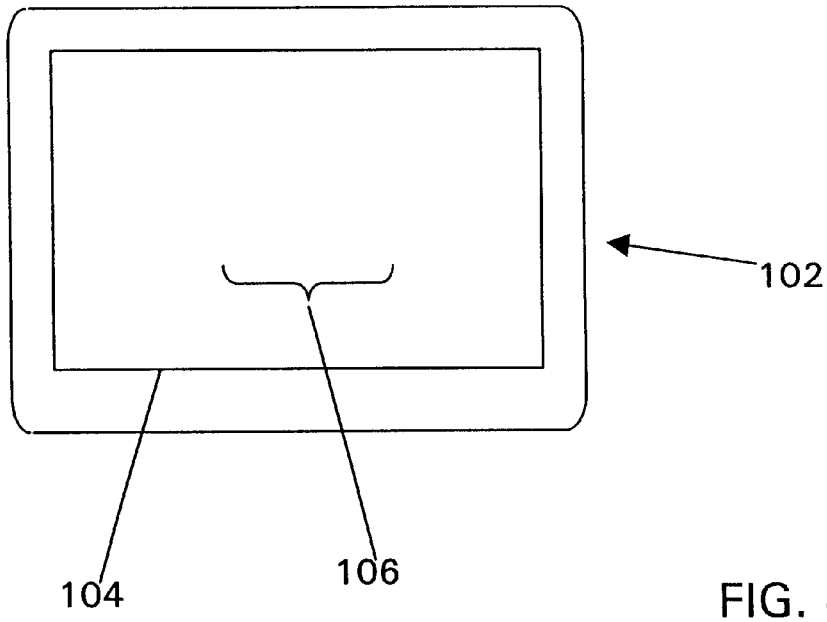
FIG. 4 is a diagram showing the screen face of the CRT depicted in FIG. 2 showing the effect of randomized, overlapping raster scans.

This is illustrated in FIGS. 3 and 4. In FIG. 3, a CRT 102 having dual electron guns but no overlap of the raster scans produces a visible line 128 (shown in dashed line fashion for purposes of illustration). However, by means of the horizontal deflection power supply 126 delivering a random current to the deflection yokes 118 and 120, an overlap 106 of the raster scans is produced with no visible marking.

Because the electron guns 112 and 114 are contained in separate necks 108 and 110, respectively, they can be closer to the display screen 104 than the single gun 16 of the conventional CRT 10 to produce an overlapped raster scan display which is the same size or larger than in the conventional CRT 10.

Although magnetic deflection yokes 118 and 120 are used in the preferred embodiment, it should be understood that in some embodiments it would be possible to substitute an electrostatic deflection mechanism.

Although the present invention has been shown and described with respect to preferred embodiments, various changes and modifications are deemed to lie within the spirit and scope of the invention as claimed. The corresponding structures, materials, acts, and equivalents of all means or step plus function elements in the claims which follow are intended to include any structure, material, or acts for performing the functions in combination with other claimed elements as specifically claimed.

What is claimed is:

1. A cathode ray display tube comprising:

a) a tube envelope;

b) a display screen;

c) a pair of electron guns for directing dual electron beams to impinge upon the display screen;

d) deflection means for deflecting the dual electron beams to produce a visual display of partially overlapping dual raster scans on the display screen;

e) wherein the tube envelope contains the display screen and the pair of electron guns; and f) wherein the deflection means causes the transfer point of each of the dual beams, within an area of the partial overlap of the dual raster scans, to be varied to minimize the possibility of a visible seam in the visual display.

2. A cathode ray display tube as recited in claim 1, wherein the deflection means comprises a pair of magnetic deflection yokes.

3. A cathode ray display tube as recited in claim 1, wherein the tube envelope includes a pair of spaced apart tube necks, each housing a different one of the electron guns.

4. A cathode ray display tube as recited in claim 3, wherein the deflection means comprises a pair of magnetic deflection yokes, each positioned around a separate tube neck.

5. A cathode ray display tube as recited in claim 4, further comprising means for supplying a random current to each of the magnetic deflection yokes.

6. A cathode ray display tube as recited in claim 1, wherein the electron guns reside in a same horizontal plane.

7. A cathode ray display tube for a television set comprising:

a tube envelope having a pair of tube necks and a phosphor display screen;

a pair of electron guns arranged in a same horizontal plane and each positioned in a different one of the tube necks, for directing dual electron beams to impinge upon the phosphor display screen;

magnetic deflection yokes positioned around a separate tube neck for horizontally deflecting the dual electron beams to produce a visual display of partially overlapping dual raster scans on the display screen; and wherein the magnetic deflection yokes cause the transfer point of each of the dual beams, within an area of the partial overlap of the dual raster scans, to be varied to minimize the possibility of a visible seam in the visual display.

8. A cathode ray display tube for a television set as recited in claim 7, further comprising means for supplying a random current to each of the magnetic deflection yokes.

* * * * *